US008545047B2

(12) United States Patent
Yip et al.

(10) Patent No.: US 8,545,047 B2
(45) Date of Patent: Oct. 1, 2013

(54) LED OBSTRUCTION LIGHT

(75) Inventors: Chak Lam Peter Yip, Hong Kong (CN); King Chung Vamco Tsoi, Hong Kong (CN)

(73) Assignee: Tri-Concept Technology Limited, Hong Kong (HK)

( * ) Notice: Subject to any disclaimer, the term of this patent is extended or adjusted under 35 U.S.C. 154(b) by 463 days.

(21) Appl. No.: 12/918,817

(22) PCT Filed: Feb. 23, 2009

(86) PCT No.: PCT/CN2009/070506

§ 371 (c)(1), (2), (4) Date: Aug. 22, 2010

(87) PCT Pub. No.: WO2009/103246

PCT Pub. Date: Aug. 27, 2009

(65) Prior Publication Data

US 2011/0002118 A1 Jan. 6, 2011

Related U.S. Application Data

(60) Provisional application No. 61/030,569, filed on Feb. 22, 2008, provisional application No. 61/078,340, filed on Jul. 4, 2008.

(51) Int. Cl.
*F21V 1/00* (2006.01)

(52) U.S. Cl.
USPC ..... 362/235; 362/382

(58) Field of Classification Search
USPC ..... 362/235, 374, 253, 230, 276, 378, 362/382, 294, 296.01
See application file for complete search history.

(56) References Cited

U.S. PATENT DOCUMENTS

2005/0201112 A1 9/2005 Machi et al.
2006/0145180 A1 * 7/2006 Galli ..... 257/99
2007/0236946 A1 10/2007 Petrakis et al.

FOREIGN PATENT DOCUMENTS

JP 2000-285702 A 10/2000
WO 2006091225 A1 8/2006
WO 2007/038156 A2 4/2007

OTHER PUBLICATIONS

P. L. L. Company, "The Emergence of LEDs—Luminance to Illumination", Lumileds Lighting US LLC, 2004.

* cited by examiner

*Primary Examiner* — Anne Hines
(74) *Attorney, Agent, or Firm* — Eagle IP Limited; Jacqueline C. Lui

(57) ABSTRACT

A light emitting diode (LED) light with a corrugated reflective surface is disclosed. The corrugated reflective surface reflects and diffuses light beams emitting from a light source having at least one LED. The corrugated reflective surface can be concavely curved. The curvature and the corrugations of the reflective surface can be designed by an equation to achieve a specified beam spread.

16 Claims, 22 Drawing Sheets

LED OBSTRUCTION LIGHT

CROSS REFERENCE TO RELATED APPLICATION

This application claims benefit under 35 U.S.C. §119(e) of U.S. Provisional Application having Ser. No. 61/030,569 filed Feb. 22, 2008 and U.S. Provisional Application having Ser. No. 61/078,340 filed 4 Jul. 2008, which are hereby incorporated by reference herein in its entirety.

FIELD OF INVENTION

This invention relates to a light emitting diode light, and in particular to a light emitting diode light with a corrugated light reflector.

BACKGROUND OF INVENTION

Light emitting diodes (LED) as light sources are becoming more and more popular, as they are more power-efficient than incandescent lights and fluorescent lights. However, the light emitting area of an LED is usually very small and is regarded as a point light source. Light is highly concentrated at the point light source and spreads into all directions. It is too bright for a human eye to directly look at the source. Therefore, there is a need to attain a uniform light profile.

SUMMARY OF INVENTION

In the light of the foregoing background, the present invention is provided.

Accordingly, the present invention, in one aspect, is to provide an LED light comprising a LED light source that comprises at least one LED mounted on a side of a circuit board, and a light reflector with a corrugated reflective surface. The corrugated reflective surface reflects and diffuses the light from the LED.

In an exemplary embodiment of the present invention, the outer surface of the corrugated reflective surface is concavely curved. A concavely curved reflective surface converges light such that the output beam is intense.

In another exemplary embodiment, the LED light source and the corrugated reflective surface are both circularly symmetric and having their centers coincide with each other.

In one exemplary embodiment, the curvature of the concavely curved corrugated reflective surface is designed by an equation to output light in a predetermined beam spread with the center of the beam spread at a predetermined angle. In another exemplary embodiment, the corrugations of the corrugated reflective surface are also designed by an equation.

In yet another embodiment, the LED light further comprises a plastic housing that is resistant to fogs, ultra-violet rays and electrostatic charges. In one embodiment, the plastic housing is totally transparent.

According to another aspect of the present invention, an LED light is provided comprising an LED light source, a power supply that supplies electrical power to the LED light and a heat insulator provided between the LED light source and the power supply. The heat insulator prevents heat exchange between the LED light source and the power supply. In one embodiment, the heat insulator is a light reflector.

In one embodiment, the LED light further comprises at least one light source heat sink attached to the LED light source and at least one heat sink attached to the power supply. Heat generated by the light emitting diode light source is dissipated by the light emitting diode heat sink, and heat generated by said power supply is dissipated by the power supply heat sink.

In another aspect of the present invention, materials used for a light reflector are described. In one embodiment, the body of the light reflector is made of a polycarbonate, and a metal coating made of a compound of nickel and cadmium is coated on the body. In another embodiment, the metal coating is coated on the body using ultra-violet coating technique.

Yet another aspect of the present invention is a power supply comprising a power supply circuit board, a top plate, a bottom plate, a metal housing and a resin. The resin is injected into a chamber bounded by the top plate, the bottom plate and the metal housing, occupying the space surrounding the power supply circuit board. The solid resin is more thermo-conductive than air, thus improving the rate heat transferred to the metal housing and the environment.

In a further aspect of the present invention, a mechanism for attaching is disclosed. It comprises a connector and a frame attached to the connector. The frame has at least one opening. At least one supporting pole runs through the opening of the frame. A first component is attached to the supporting pole and a compression spring is provided surrounding each supporting pole between the first component and the frame. A second component is provided with a socket suitable for insertion of the connector. When the socket is pushed towards the connector, the frame slides along the supporting pole. The compression spring is compressed, pushing the connector towards the socket to tighten the insertion.

In another aspect of the invention, a method for producing diffused light from a point light source is described. The method comprises providing at least one point light source that emits light, and providing a corrugated reflective surface. The corrugated reflective surface reflects and diffuses light from the point light source to produce diffused light.

In one aspect of the invention, a method for increasing the life of an LED light is described. The method comprises separating the LED light and a power supply that supplies electrical power to the LED light with a heat insulator, such that heat exchange is prevented between the LED light and the power supply while providing separate heat dissipation path for these two different elements.

DETAILED DESCRIPTION OF THE PREFERRED EMBODIMENTS

The innovative concepts of this invention are best illustrated using an obstruction light as an example. Obstruction lights are lights that warn aviators or pilots about obstructions in the environment, and are usually installed on runways in airports or on the roof of buildings for instance. There are many types of obstruction lights according to a standard defined by the Federal Aviation Administration (FAA), with different light colors, flashing frequencies, and beam spreads. For the purpose of this description, the obstruction light is an L-810 type "steady-burning red obstruction light" light unit. An L-810 light unit is required to have a vertical beam spread of at least 10 degrees and the center of the beam spread must be between +4 and +20 degrees with respect to horizontal. A horizontal beam spread of 360 degrees or horizontal omnidirectionality must also be achieved.

In all embodiments described herein, it is presumed that the obstruction lights are installed in an upright configuration for ease of explanation. That means fixtures and sockets are facing upwards and connectors are facing downwards. In the context of this description, "lateral" means parallel to the configuration of the obstruction light i.e. vertical, and "traverse" means perpendicular to the configuration of the obstruction light i.e. horizontal. Also, "body" means parts of obstruction light that are secured to the fixture and do not displace due to movement of any springs.

Figure 1:
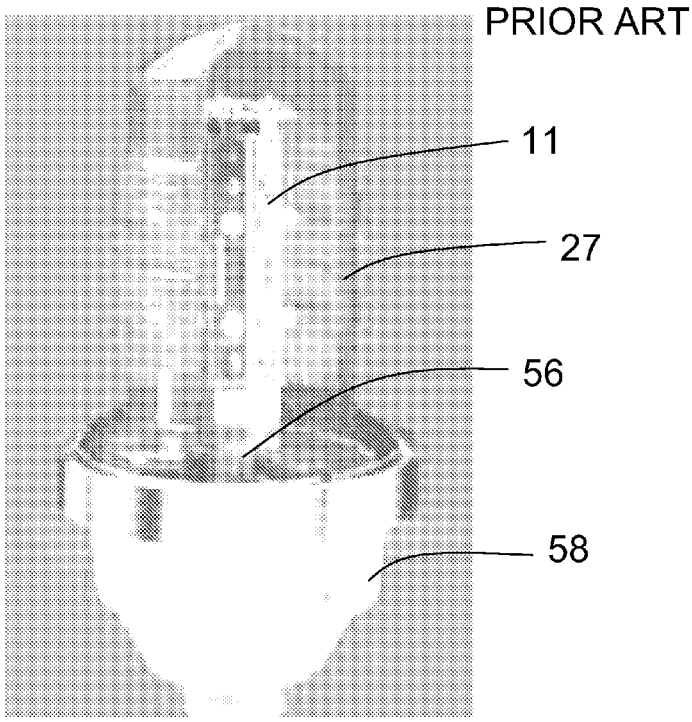
FIG. 1 is a front elevation view of a prior art device.

Referring to FIG. 1, a diagram of a prior art device is shown. A light source 11 is covered by a plastic dome 27. The light source 11 is mounted on a socket and the plastic dome 27 is attached to a base fixture 58. The light source 11 emits light beams, and the plastic dome 27 is red in color such that the output light beams are red and it looks red when power is turned off.

The light-emitting area of an LED is very small that it can be regarded as a point light source. A point light source generates a high intensity at a small area, so the light is very concentrated and it is stimulating to a human eye looking directly into it. The human may lose vision for a few seconds when he looks directly into a bright spot like this, and it causes safety concerns for the pilot and passengers inside a plane.

Figure 2:
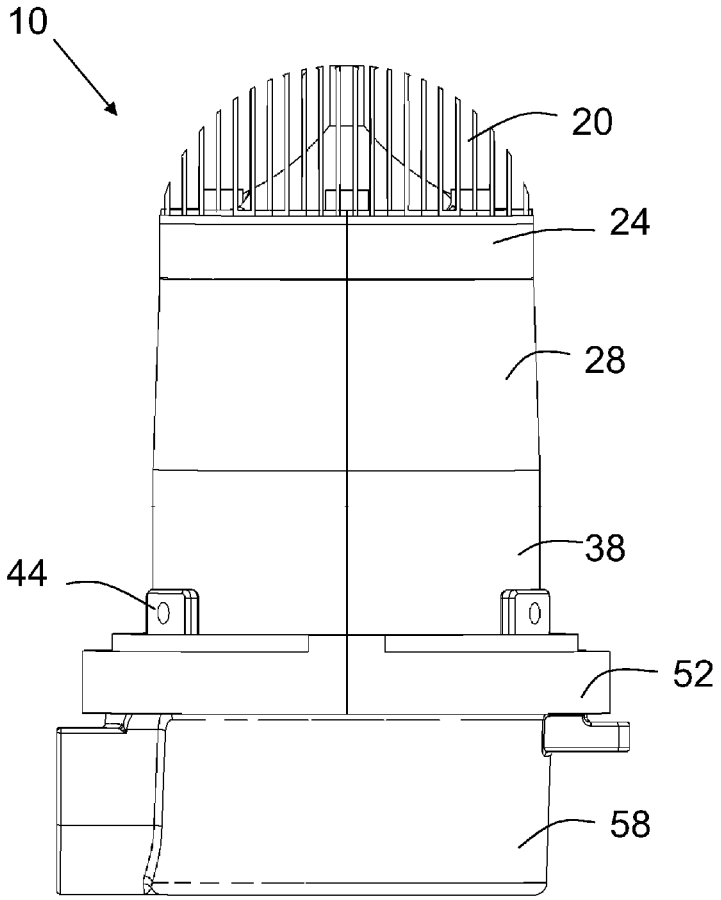
FIG. 2 is a front elevation view of an LED obstruction light according to an exemplary embodiment.

A first embodiment of this invention is an LED obstruction light 10 as shown in FIG. 2. The top part of the LED obstruction light 10 is a heat sink 20 that is attached to a light source facing downwards (not shown). A plastic housing 28 is attached to the heat sink 20 from bottom. A light reflector (not shown) is provided inside the plastic housing 28. A metal housing 38 is provided below the plastic housing 28, and the metal housing 38 is attached to a base fixture 58 through a bottom connector ring 52. A plurality of hook attachments 44 are provided outside the metal housing 38.

In operation, the light source emits light beams downwards onto the light reflector. The light source and the light reflector are both circularly symmetric, so that light beams are reflected radially outwards in all angles. The light beams pass through the plastic housing 28 to the environment. The bottom connector ring 52 and the hook attachments 44 are for attaching purposes.

Figure 3A:
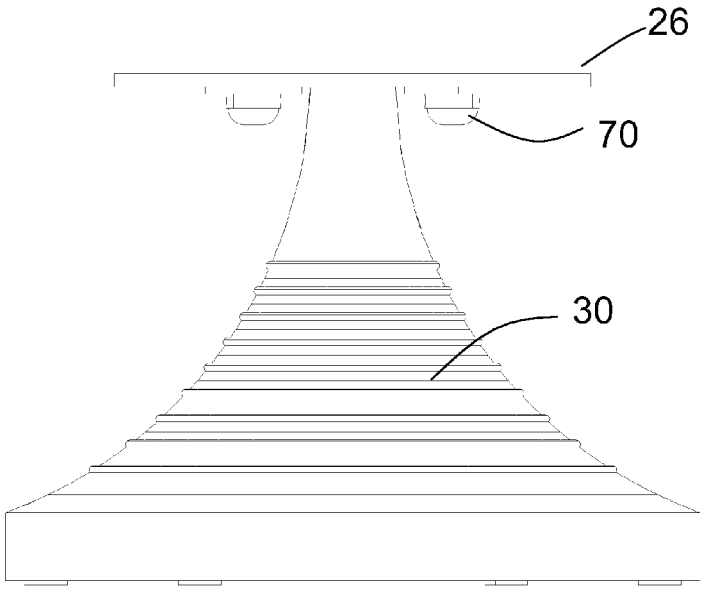
FIG. 3*a* is a front elevation view of an LED light source and a light reflector according to an exemplary embodiment.

FIG. 3*a* shows an exemplary embodiment of the LED PCB 26 and the light reflector 30. Eight LEDs 70 are mounted on the LED PCB 26 in a circular pattern, facing downwards. The light reflector 30 is generally in the shape of a cone, but the outer surface of the light reflector 30 is concavely curved and the top of the light reflector 30 is cut off. The LEDs 70 and the light reflector 30 are both circularly symmetric, and the center of the LED PCB 26 coincides with the center of the light reflector 30, making the whole system also circularly symmetric. A hole is opened at the center of the light reflector 30 for electrical wires (not shown) to run from the power supply PCB (not shown) to the LED PCB 26. A more detailed description of the light reflector 30 is provided below.

Figure 3B:
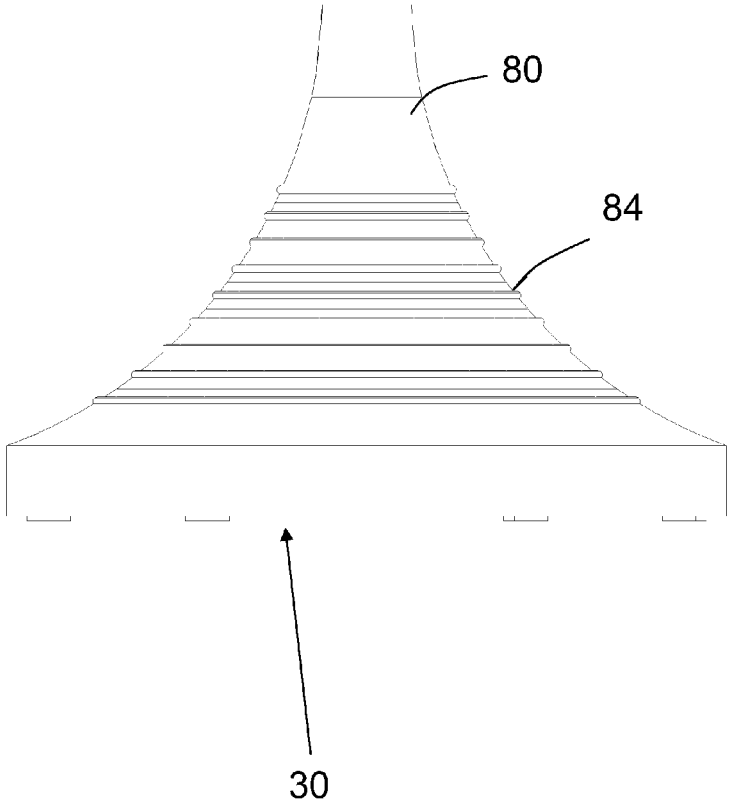
FIG. 3*b* is a cross sectional view of the light reflector as shown in FIG. 3*a*.

Referring now to FIG. 3*b*, a more detailed view of the light reflector 30 is illustrated. The body of the light reflector 30 is a plastic cone 80 with a series of corrugations 84 provided along its outer surface. The corrugations 84 are generally semi-circular in shape and a space is provided between the corrugations 84. The outer surface of the plastic cone 80 is coated with a layer of metal coating. In one embodiment, the corrugations 84 are provided continuously along the outer surface of the plastic cone 80.

The outer surface of the plastic cone 80 is concavely curved to converge the light emitting from the LEDs 70 (not shown) that is shone onto the light reflector 30. The act of converging increases the total and average light intensity that passes through the plastic housing 28, comparing to the case where a planar reflective surface is used. In one embodiment, if the relative position of the LEDs 70 to the light reflector 30 is known, the concave curve can be designed by an equation such that light escapes the plastic housing 28 with a predetermined vertical beam spread and with the center of the beam spread at a specified angle.

The corrugations 84 are provided to diffuse the light shone on the light reflector 30 such that a bright spot is not able to be seen by a human eye even if he is looking directly at the light reflector 30. Each corrugation 84 reflects the light shone on that particular area into a wide range of output angles, comparing to a smooth surface that reflects into a very small range of output angles. If the light intensity is high at that particular area, a smooth surface will result in highly concentrated reflected light, and the user will see a bright spot. Whereas when the corrugations 84 are provided, each corrugation 84 acts as a diffuse light source that emits. In one embodiment, the corrugations 84 are designed by an equation to achieve a predetermined vertical light profile. In another embodiment, the diameter of each corrugation is different.

Figure 3C:
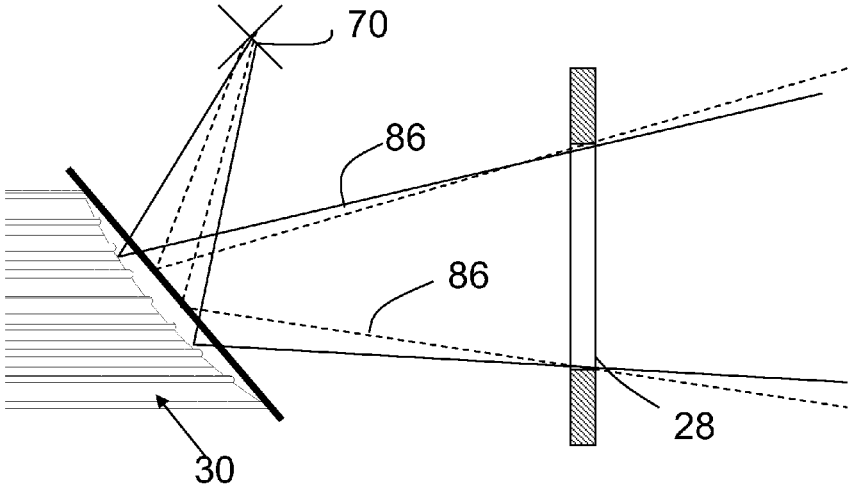
FIG. 3*c* is a ray diagram of an LED light source using a planar smooth reflector.
Figure 3D:
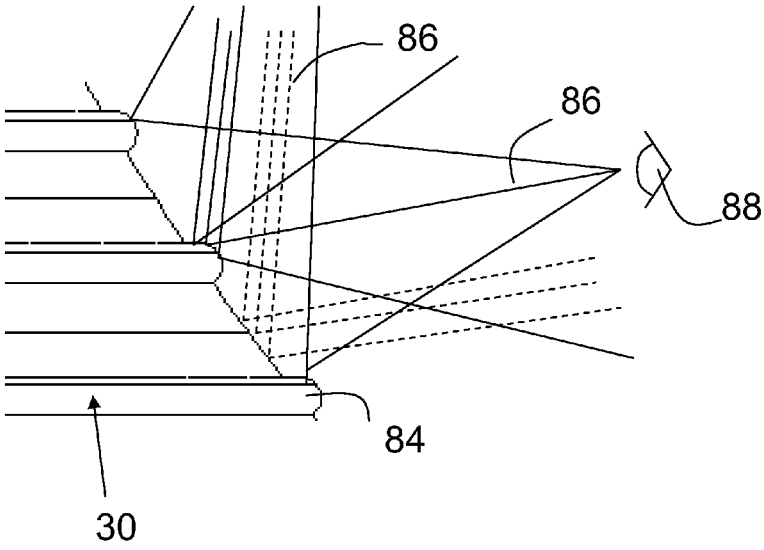
FIG. 3*d* is a ray diagram of an LED light source using a light reflector according to an exemplary embodiment.

Exemplary ray diagrams of the present invention are shown in FIGS. 3*c* and 3*d*. FIG. 3*c* shows the effect of using a concavely curved light reflector 30. The bold straight line represents a planar light reflector having the same top and bottom boundaries. The solid straight lines are the light beams 86 that shine onto and are reflected by the concavely curved light reflector, and the dashed lines represent the corresponding light beams with the planar reflector used instead. The figure shows that a larger range of angles can be reflected to pass through the plastic housing 28 using the concavely curved light reflector 30, with a smaller output beam spread. The larger range of angle means the total output intensity is increased, and the smaller output beam spread means the average intensity over the beam spread is increased.

FIG. 3*d* shows a magnified diagram of the corrugations 84 and the path of light beams 86 that hit on it. The solid lines hit on the corrugation 84 and the dashed lines hit on a smooth part of the light reflector 30. The corrugation 84, being generally in the shape of a semi-circle, diffuses the light beams 86 into a wide range of output angles. In comparison, the reflected light from the smooth part of the light reflector 30 is still highly parallel to each other. Each corrugation 84 effectively acts as a diffuse light source that emits light into a wide range of angles, so that when the user looks into the light reflector 30, the user sees light reflected from more than one corrugation 84, as illustrated by the light beams 86 that reaches a human eye 88 as shown in the figure.

One problem associated with using a light reflector 30 instead of directly emitting light beams to the environment is that the light reflector 30 is not perfect. The light shining on the light reflector 30 is either reflected or absorbed by the light reflector 30. All absorbed light is converted into heat energy, thus heating up the light reflector 30. Therefore, the material used for the metal coating 82 and the plastic cone 80, and the technique used for coating are all important as they all directly affects the percentage of light reflected, or referred to as reflection ratio, which is the efficiency of the LED obstruction light. The reflection ratio changes with wavelength, and red light is used for the test. A series of tests are undertaken for a list of materials used for both the metal coating 82 and the plastic cone 80. It is found that coating a compound of nickel and cadmium on a polycarbonate gives the best reflection ratio, achieving a maximum of 97.8%. In another embodiment, aluminum is plated onto the plastic cone 80 instead of nickel cadmium.

Figure 3E:
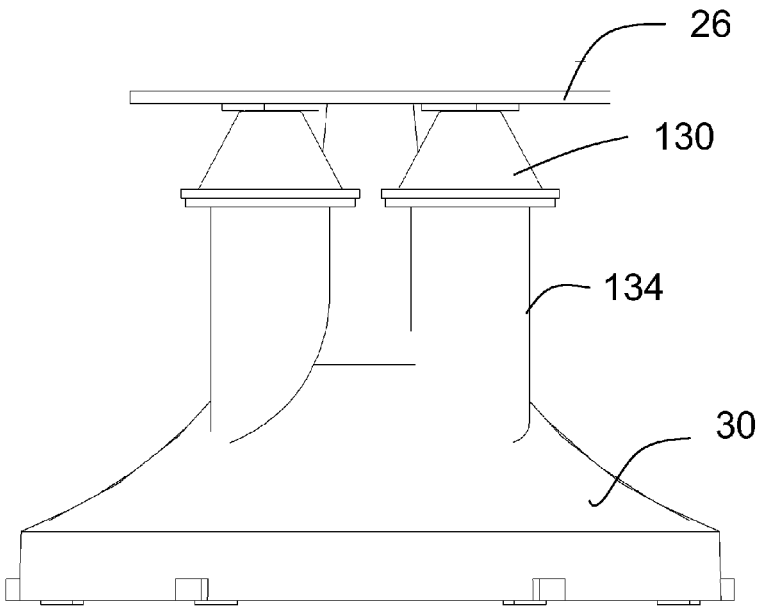
FIG. 3*e* is a front view of an embodiment having a condensing cup with the light reflector, and shows the light rays emitting out from the condensing cup.

In another embodiment shown in FIG. 3*e*, a condensing cup 130 is attached to each LED on the LED PCB 70. The condensing cup 130 focuses the beam emitted from the LEDs 70 into a much smaller spread before impinging onto the light reflector 30. By controlling the beam spread of the impinging light to the light reflector 30, the output beam spread becomes more controllable and less intensity is lost. In the diagram, condensing cup light beams 134 are shown as emitting from the condensing cups 130 straightly downwards.

Figure 3F:
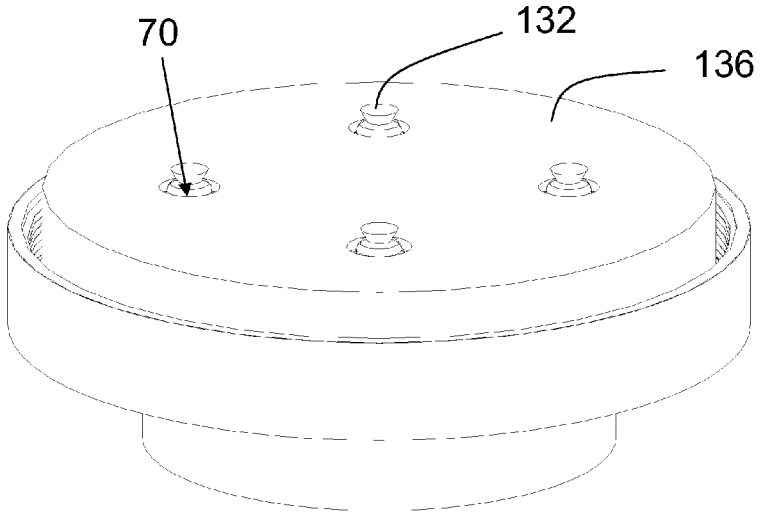
FIG. 3*f* is another embodiment for sideway beam generation, showing the LED fitted with a lens with a reflective surface.
Figure 3G:
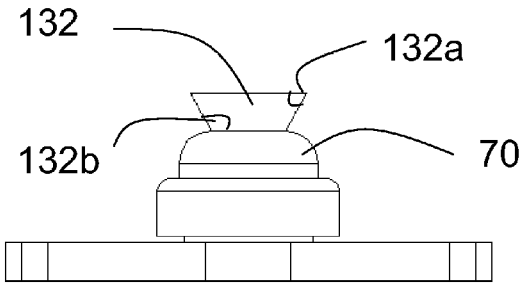
FIG. 3*g* is a front elevation view of an LED shown in FIG. 3*f*.

In an alternative embodiment as shown in FIGS. 3*f* and 3*g*, each LED 70 is fitted to a lens 132. The LEDs 70 are covered by a bottom reflective surface 136 and only the lenses 132 are exposed. The material and shape of the lens 132 is specially designed to reflect the light sideways to comply with FAA requirements of beam spread. The lens 132 is in a shape of an inverted truncated cone. As the lens 132 is circularly symmetric, the output light achieves horizontal omnidirectionality.

Figure 3H:
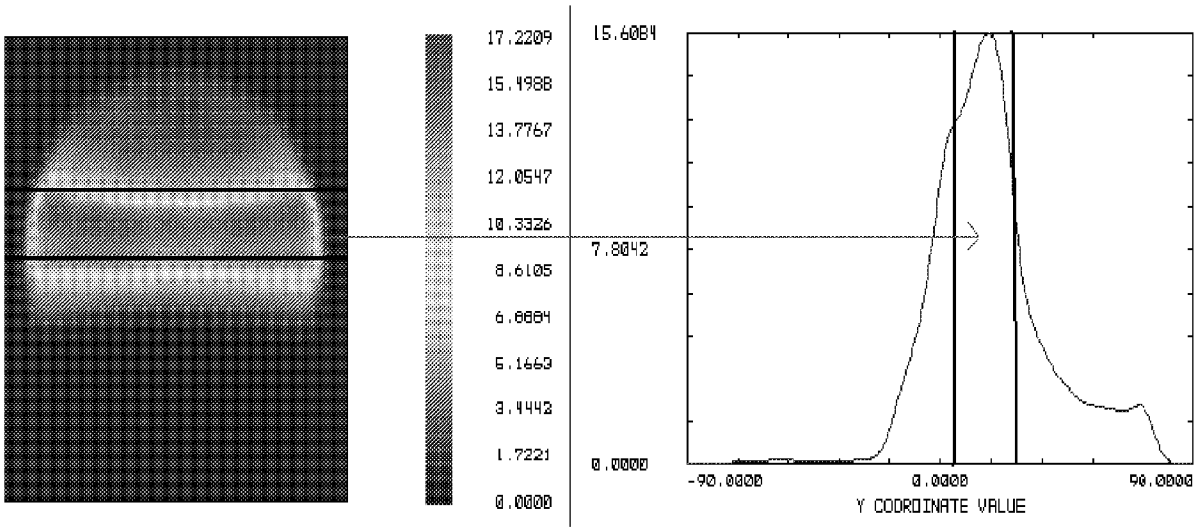
FIG. 3*h* is a graph plotting the intensity curve with respect to the vertical angle from experiment of the LED shown in FIG. 3*g*.

A graph of light intensity versus vertical angle using the LED as illustrated in FIG. 3*g* is shown in FIG. 3*h*. The horizontal-axis of the graph is the vertical angle from −90 degrees to +90 degrees, and the vertical-axis of the graph is the light intensity of the light in candela. The two vertical bold lines correspond to +4 degrees and +20 degrees. As shown in the graph, the peak of the graph, which is the center of the beam spread, lies between +4 degrees and +20 degrees, and most of the output intensity is within +4 degrees and +20 degrees, meaning that little intensity is wasted at non-intended angles. This complies with the FAA requirement of L810 type obstruction lights.

Since obstruction lights are installed at hard-to-reach locations and are exposed to all weather effects, there is a need to ensure that the light intensity must meet the minimum luminance requirement regardless of the conditions. Among all the parts exposed to the environment, the plastic housing 28 is most easily affected by weather, and it is also the most important since light beams must pass through it to the environment. First of all, the plastic housing 28 must be highly transparent to the range of wavelength of lights that the LEDs 70 emit. As described above, the more light is trapped, the more heat is generated, and this greatly impacts the lifetime of the light. In one embodiment, the plastic housing 28 is red in color to only allow red light to pass through. In another embodiment, the plastic housing 28 is transparent to all wavelengths in the visible light range. The LEDs 70 in this case are red LEDs. Also, the plastic housing 28 should be resistant to ultra-violet (UV) rays since prolonged exposure to UV rays makes the plastic housing 28 breaks more easily and may change the color of the plastic housing 28 that the light color does not satisfy the requirement. It also needs to be free of electrostatic charge since electrostatic charge attracts dust to settle on the plastic housing 28 and blocks some light. Similarly, an anti-fog coating is needed to prevent water molecules from precipitating on the housing surface and reducing its efficiency. In an embodiment, the material used for the plastic housing 28 is a transparent polycarbonate with a layer of anti-fog coating, a layer of anti-UV coating and a layer of anti-electrostatics coating deposited on the top of it.

An LED light source is required to have a life of around 50,000 hours. However, in reality, there are many problems that reduce the life of an LED light source, one of them being a heat problem. An LED light source generates a lot of heat, and without a good heat dissipation mechanism, the temperature at the light source is high during operation. As a result, circuit components break down more easily and the life of the light source is shortened. A heat dissipation mechanism is therefore needed to lower the temperature at the light source and extend the life of an LED light source.

For any LED light, a power supply is provided to produce a fixed or regulated current to supply electrical power to the light source, and the power supply generates heat in the process. In one embodiment, a heat insulator is provided between the light source and the power supply such that heat exchange is prevented between the light source and the power supply. Prevention of heat exchange means that heat generated from the power supply does not increase the temperature at the light source and vice versa, thus achieving a lower operating temperature and extending the life of both the light source and the power supply. In one embodiment, the heat insulator is the light reflector 30.

In another embodiment, at least one heat sink is dedicated to dissipate heat generated from the light source, and at least one heat sink dissipates heat generated from the power supply, hence providing two separate heat dissipation paths for the two heat sources. In one embodiment, the heat sink 20 is dedicated to the light source and the metal housing 38 is dedicated to dissipate heat from the power supply.

Figure 4:
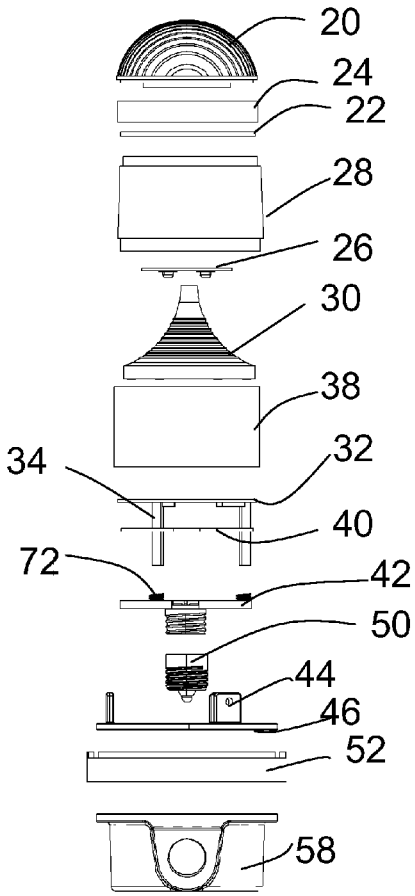
FIG. 4 is an exploded assembly view of the light as shown in FIG. 2.

Referring now to FIG. 4, an exploded assembly diagram of an exemplary embodiment of the LED obstruction light 10 is illustrated. A top rubber ring 22 is provided inside the top connector ring 24 between the heat sink 20 and the plastic housing 28. The LED PCB 26 is attached to the heat sink 20 and the light reflector 30 is provided below the LED PCB 26. Inside the metal housing 38 is a top plate 32 attached to an end of three supporting poles 34. A power supply PCB (not shown) is provided between the top plate 32 and a bottom plate 40. Each supporting pole 34 runs through an opening in the bottom plate 40, a compression spring 72 and an opening in a connector support frame 42, and then is attached to an attaching ring 46 at the other end. A connector 50 is attached to the connector support frame 42. The attaching ring 46 is attached to the bottom of the metal housing 38, and also has a plurality of hook attachments 44 extending upwards outside the metal housing 38. The bottom connector ring 52 is attached to the attaching ring 46 and the base fixture 58. A socket (not shown) is provided inside the base fixture 58. The following paragraphs provide a more detailed explanation of the functions of each part.

Figure 5A:
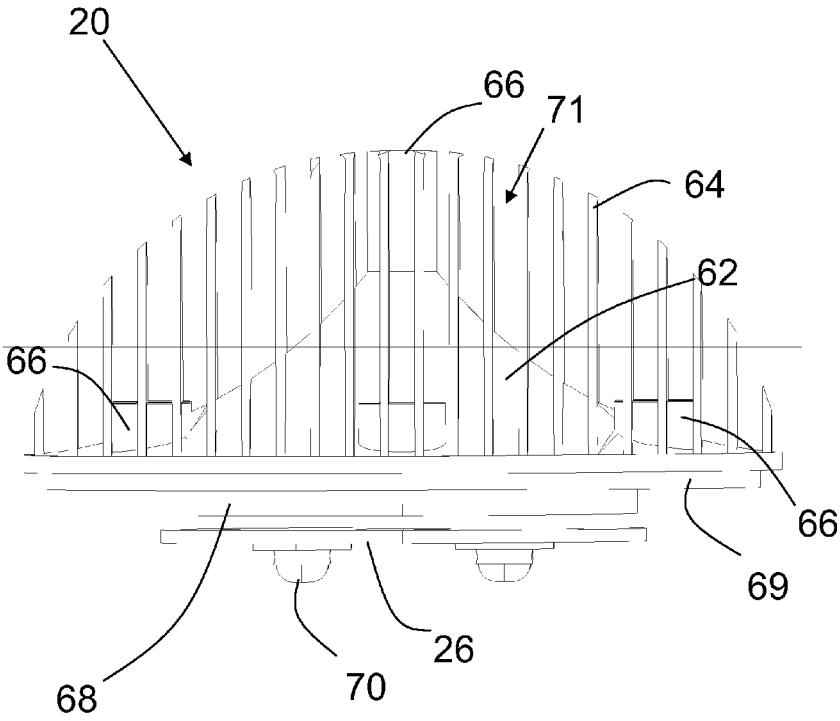
FIG. 5*a* is a perspective view of a heat sink according to an exemplary embodiment.

FIG. 5*a* shows an exemplary embodiment of the heat sink 20. A base plate 68 is provided to attach to the light source which is an LED printed circuit board (PCB) 26 having at least one LED 70. A center plate 69 is attached above the base plate 68. On the center plate 69 is a cone-shaped inside structure 62 with the cone slightly concave in shape. Above and around the cone-shaped inside structure 62 is a plurality of screw inserts 66 for attaching to the plastic housing 28 (not shown). A plurality of parallel fins 64 are provided extending upwards from the center plate 69. An interspace 71 exists between each pair of fins 64 and they are designed to be in a dome shape.

Figure 5B:
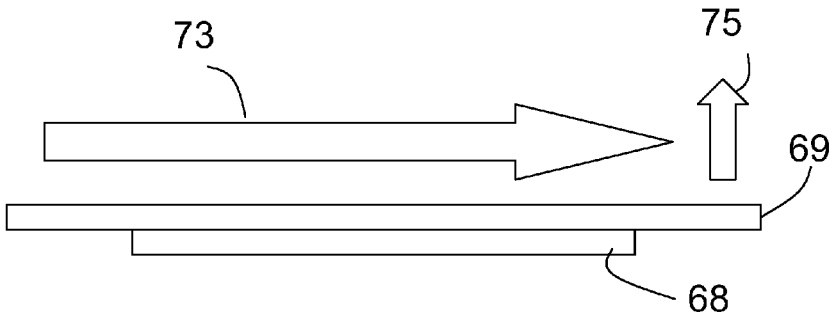
FIG. 5*b* is an air flow diagram of a heat sink without a cone-shaped inside structure.
Figure 5C:
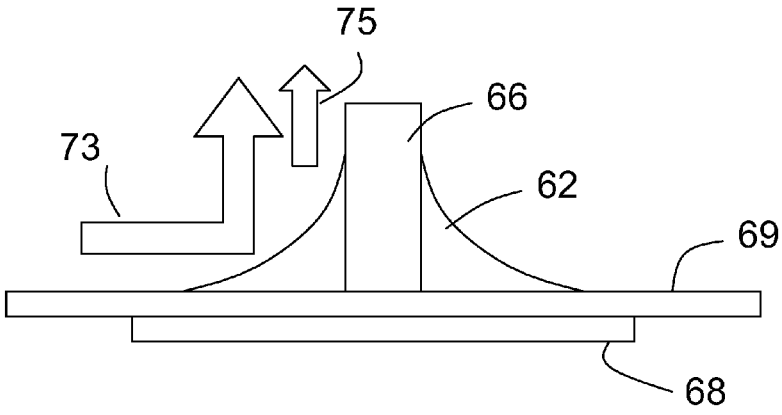
FIG. 5*c* is an air flow diagram of a heat sink with a cone-shaped inside structure according to an exemplary embodiment.

Referring to FIGS. 5*b* and 5*c*, the cone-shaped inside structure 62 is provided to facilitate air flow in the plane parallel to the fins 64. From the principles of convection, hotter air flows upwards and colder air flows downwards. Without the cone-shaped inside structure 62, cold air entering the heat sink 20 from one side leaves at the other side, as indicated by an air flow arrow 73. Heat absorbed while the air is inside the interspace 71 causes the heated air to change its flow direction slightly upwards, as shown by a convection air flow arrow 75. With the cone-shaped inside structure 62, as cold air flows into the interspace 71 and gets heated up, the cone-shaped inside structure 62 guides the heated air upwards and escapes the heat sink 20 close to the center of the heat sink 20, as the figure shows the air flow arrow 73 turning upwards. The direction of exit air flow is now the same as the direction due to convection effect, thus the speed of the exit air flow is effectively increased and more air can enter the heat sink 20.

To efficiently dissipate the heat generated by the LED PCB 26, the LED PCB 26 is fabricated on a single circuit board, with its back side attached to the base plate 68. The area of contact between the heat source and the base plate 68 should be as large as possible to maximize heat transfer. The surface of the base plate 68 is usually not smooth and results in having an air gap in some areas when other areas are already in contact. Since air is a poor heat conductor, having air gaps greatly reduces the efficiency of the heat sink 20. In one embodiment, the base plate 68 is polished such that the surface is as smooth as possible to maximize the contact area to the heat source.

Figure 5D:
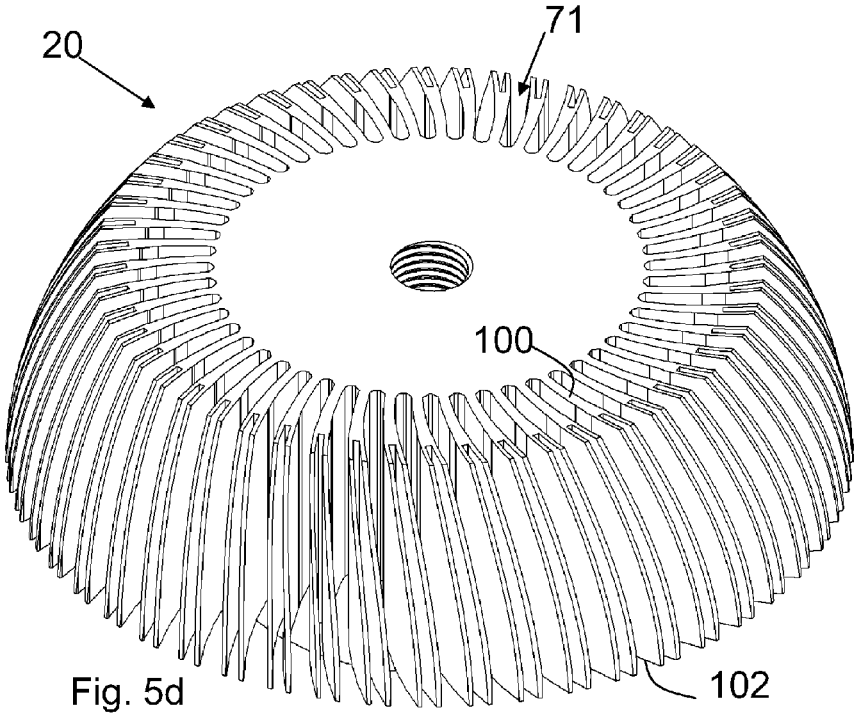
FIG. 5*d* is a perspective view of another exemplary embodiment of the heat sink.
Figure 5E:
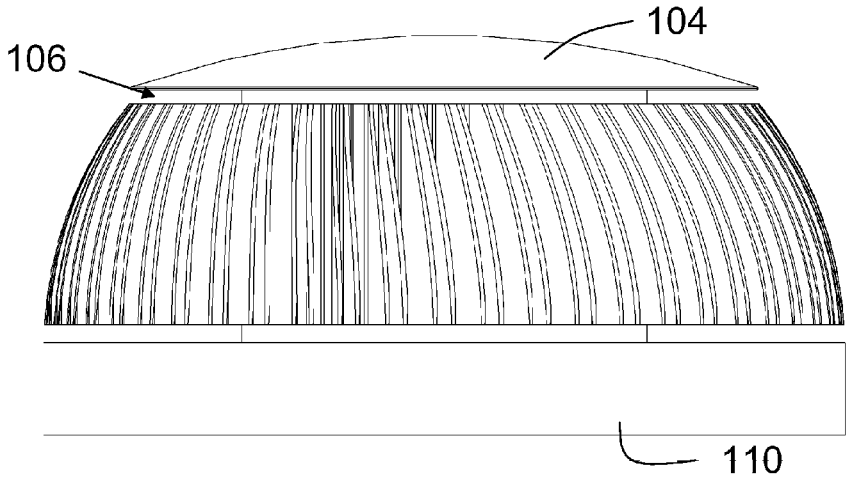
FIG. 5*e* is a side view of the exemplary embodiment shown in FIG. 5*d*.
Figure 5F:
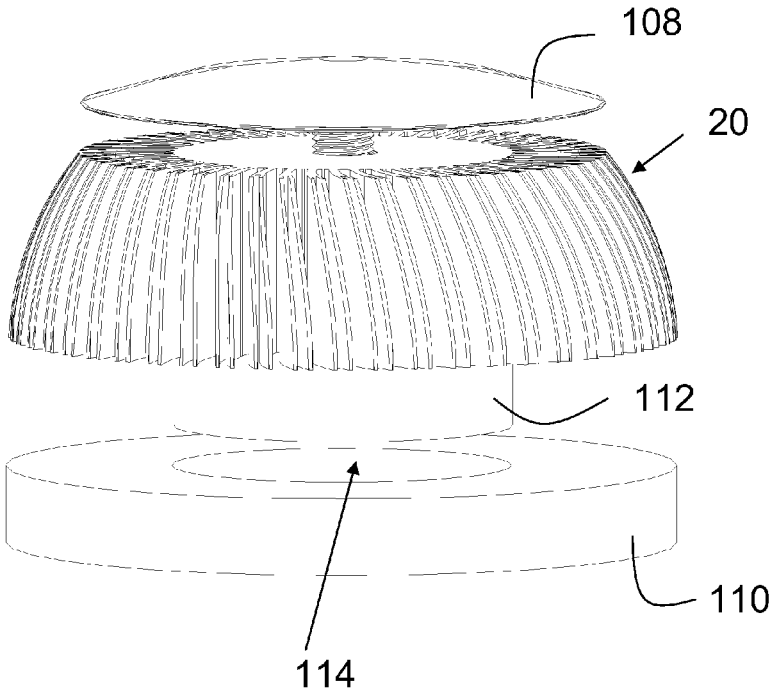
FIG. 5*f* is an exploded assembly diagram of the exemplary embodiment shown in FIG. 5*d*.

In another embodiment as shown in FIGS. 5*d*-5*f*, the heat sink 20 is circularly symmetric. A plurality of curved fins 100 extend from the center of the heat sink 20 in the form of a sunflower, with interspaces 71 in between. Each curved fin 100 is further split into two sub-fins 102 near the peripheral end. A heat sink cover 104 is attached to the top of the heat sink 20. A top air gap 106 is provided between a bottom surface of the heat sink cover 104 and the top surface of the heat sink 20. A bottom cover 110 having a bottom cover opening 114 is attached to an inner pipe 112 of the heat sink 20. The bottom cover 110 is also attached to a heat source not shown in the figure, for example a LED PCB. The heat sink cover 104 combined with the heat sink 20 is designed to be in a generally dome shape.

The top air gap 106 and the bottom air gap 108 are provided to improve ventilation capacity. Having the air gaps allow hot air to escape the heat sink 20 from the top or bottom, in addition to radially outwards. Cold air from the environment can blow through the air gaps and bring heat away from the heat sink 20, while preventing unwanted objects like rain from entering the interspaces 71 from above.

The heat sink 20 is made in dome shape because a dome-shaped heat sink 20 gives a better performance than being cylindrical. The reason for that is a dome-shaped heat sink possesses less air resistance to winds blowing from a horizontal direction. Less air resistance results in faster air movement and thus performance is enhanced. Experimental results showed that using this configuration, the temperature of the heat sink 20 remains below 60 degrees Celsius in continuous operation at room temperature of 30 degrees Celsius.

The attachment between the bottom cover 110 and the heat sink 20 is preferred to be as tight as possible for maximum heat dissipation capacity. In this embodiment, the bottom cover 110 made of aluminum alloy is first heated up to a temperature of about 280 degrees Celsius. By heating up the bottom cover 110, the bottom cover 110 expands and the size of the bottom cover opening 114 increases. Then the inner pipe 112 of the heat sink 20 is inserted into the bottom cover opening 114. The outer diameter of the inner pipe 112 is the same as or slightly smaller than the diameter of the bottom cover opening 114, such that when the bottom cover 110 cools down to room temperature, the bottom cover opening 114 shrinks and tightly holds the inner pipe 112. This solution gives a much tighter attachment than using screws or bolts and is easy to carry out. It also results in the least amount of tiny and irregular air gaps between atoms of the two components.

Figure 5G:
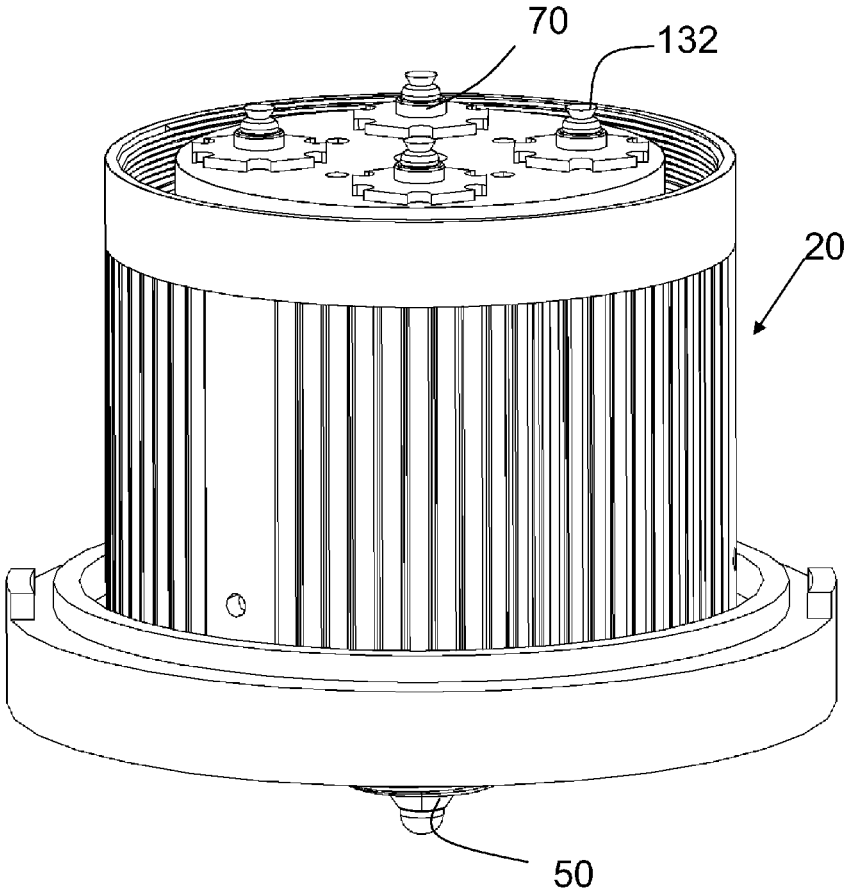
FIG. 5*g* is a perspective view of an alternative embodiment showing the light source facing upwards and the heat sink under the light source.

In an alternative configuration as shown in FIG. 5*g*, the LEDs 26 are facing upwards instead of downwards. The lens 132 as described in FIG. 3*f* is used in this embodiment to reflect the light sideways. The heat sink 20 then needs to be under the LEDs 70 such that it can be attached to the LED PCB but not obstructing the path of emitted light.

In this configuration, the heat sink 20 is designed to be installed in the middle portion of the obstruction light 10, under the light source as shown in FIG. 5*g*. The curved fins 100 are still present in this embodiment, but the length of each curved fin 100 is shorter to be more compact. The sub-fins 102 are not implemented in this embodiment as the length of the curved fins 100 are made shorter to be more compact. Three screw holes 116 are provided around the heat sink 20 in a circularly symmetric fashion. A heat sink opening 118 is provided at the center of the heat sink 20 and a plurality of grooves 120 are provided at the inner surface. The heat sink 20 is cylindrical in shape and the air gap is absent in this embodiment, but it is clear that dome-shaped configuration can still apply to this embodiment. In another embodiment, the top air gap is present at the top of the heat sink 20.

Most buildings have the base fixtures 58 already installed. The base fixtures 58 usually have an E27 type socket for coupling to an incandescent bulb. Different manufacturers develop different base fixtures 58. Although they all use the same E27 type electrical socket, the relative height and positions of E27 sockets against the base fixtures are different for different manufacturers. A connector 50 that is fixed to one location may fit one type of obstruction light from one manufacturer but may be too tall or short for other lights when it is installed to the base fixtures 58. To effectively reuse all existing base fixtures 58 from different manufacturers, a mechanism is needed to allow the connector 50 to be able to operably secure to sockets of different heights without knowing the height of each socket beforehand.

Figure 6A:
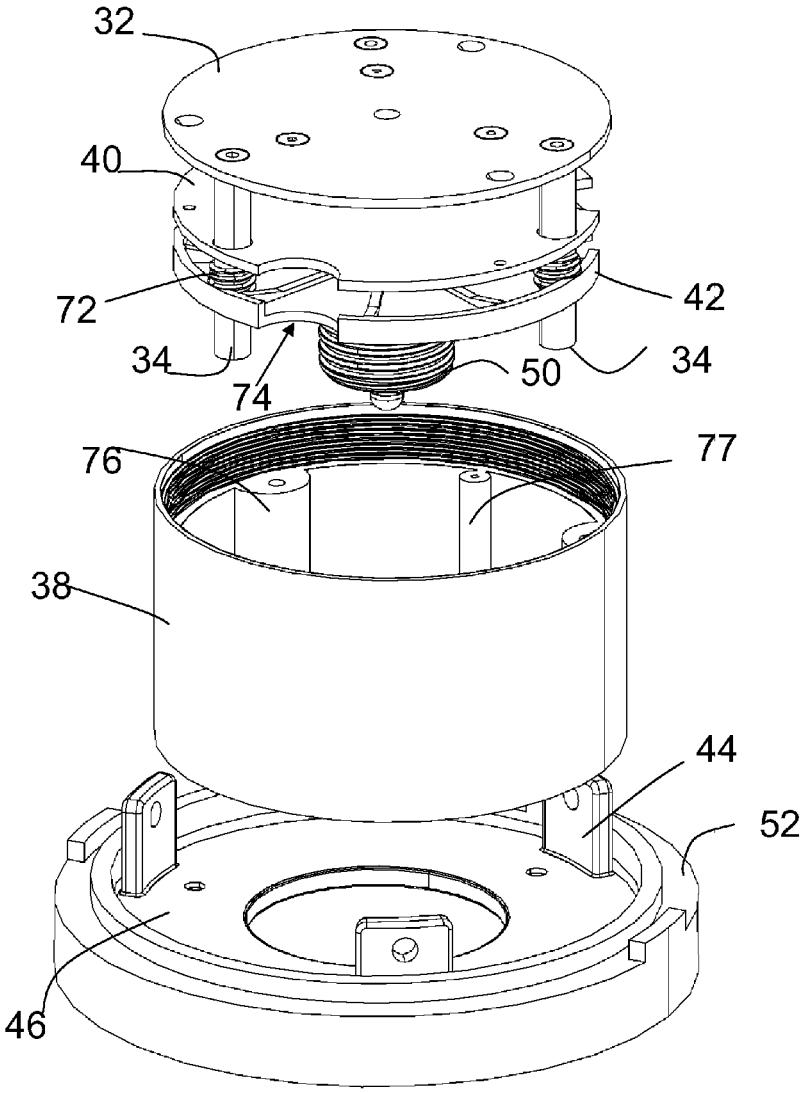
FIG. 6*a* is a perspective view of a power supply and a connector of the light according to an exemplary embodiment.

FIG. 6*a* shows an exemplary embodiment of a solution to the problem. A plurality of compression springs 72 are provided to insert through the supporting poles 34 below the bottom plate 40. A connector support frame 42 is then inserted through the supporting poles 34 under the compression springs 72. The connector support frame 42 is then attached to the connector 50 for inserting into the socket (not shown). Six attachment columns are made at the inside wall of the metal housing 38. The attachment columns are of two lengths and they are used to attach to different parts. The short attachment columns 77 are attached to the bottom plate 40 while the long attachment columns 76 are attached to the attaching ring 46.

When the light is installing on a pre-existing base fixture 58, the socket will push against the connector 50. The connector support frame 42 that is attached to the connector 50 is then pushed upwards. The connector support frame 42 slides along the supporting poles 34 to ensure that the connector 50 is facing the same direction and correctly aligned to the socket while moving. When the connector support frame 42 is pushed upwards, the compression springs 72 compresses and exerts a downward force on the connector support frame 42. This downward force ensures a tight connection when threading the connector 50 into the socket.

Figure 6B:
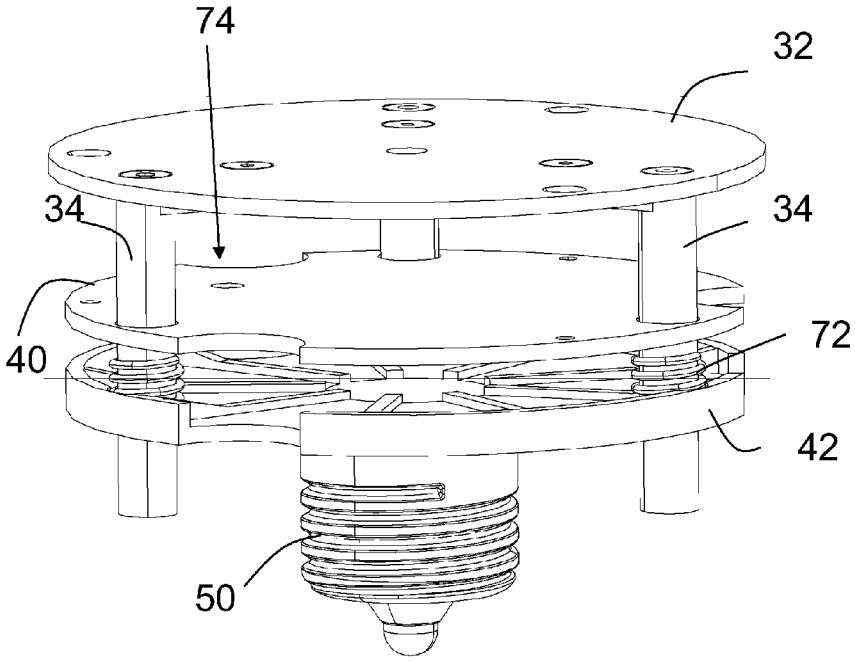
FIG. 6*b* is a detailed perspective view of the connector as shown in FIG. 6*a*.
Figure 6C:
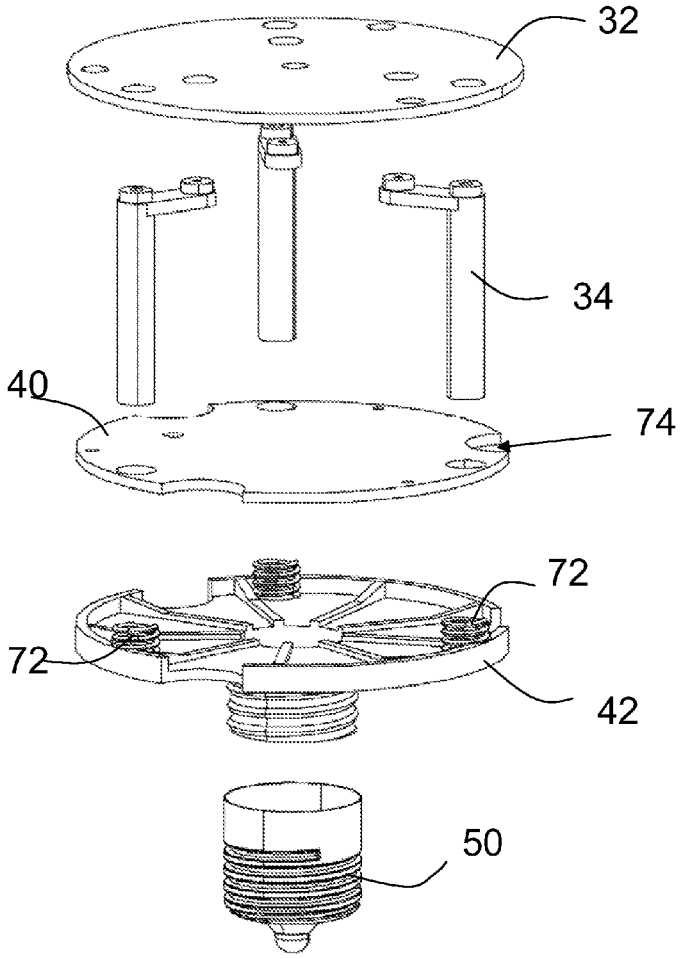
FIG. 6*c* is an exploded assembly view of the connector shown in FIG. 6*b*.

Referring to FIGS. 6*b* and 6*c*, an interlocking mechanism is shown. A plurality of recesses 74 are provided at the bottom plate 40 to allow the long attachment columns (not shown) to pass through. On the top plate 32, a hole is made for the electrical wires (not shown) to pass through en route to the LED PCB 26 (not shown). Also, a hole is made at the bottom plate 40 for electrical wires to run to the connector 50 (not shown). The connector 50 is threaded into the connector support frame 42.

Figure 6D:
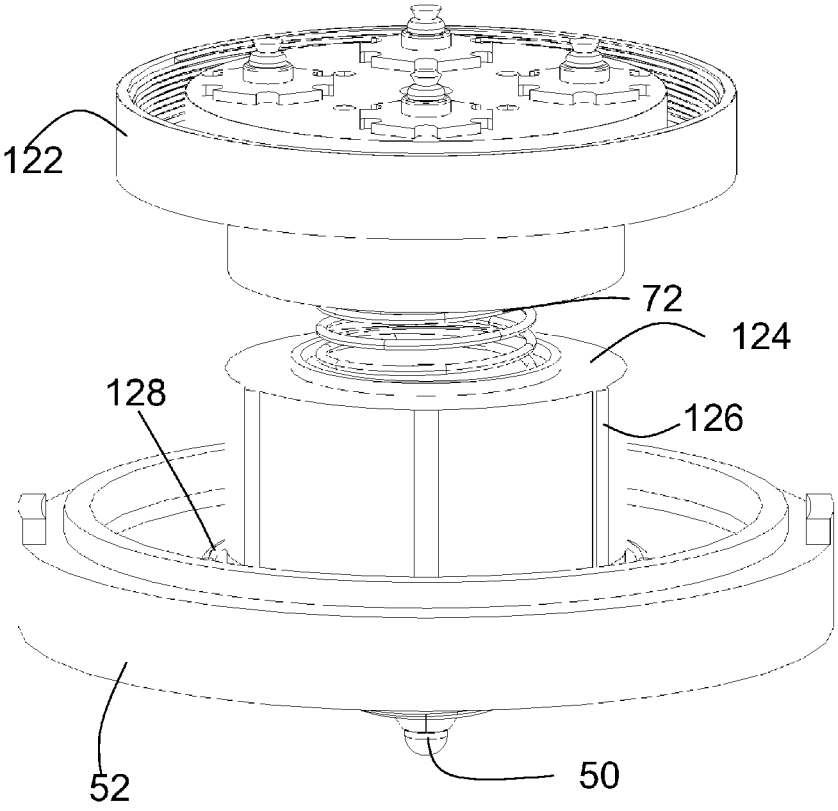
FIG. 6*d* is a perspective view of another exemplary embodiment of the power supply and connector.
Figure 6E:
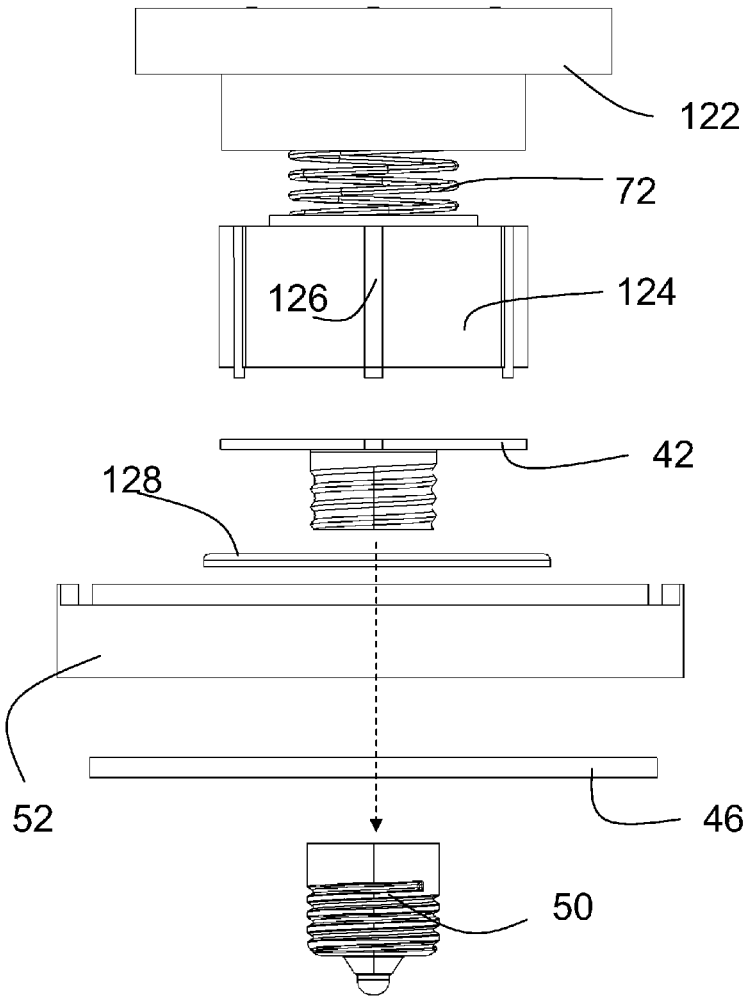
FIG. 6*e* is an exploded assembly view of the embodiment as shown in FIG. 6*d*, in the front direction.

In another embodiment as shown in FIGS. 6*d* and 6*e*, a single vertical compression spring 72 is installed at the center of the obstruction light. The top end of the compression spring 72 is attached to a top member 122. The bottom end of the compression spring 72 is attached to a bottom member 124. The bottom member 124 houses the power supply of the light, and has a plurality of vertical ridges 126 along its outside surface. The connector support frame 42 is disposed under the bottom member 124, and is attached to the vertical ridges 126. Under the bottom member 124 are the bottom connector ring 52 and the attaching ring 46. A rubber gasket 128 is fixed on the attaching ring 46 for shock-proofing and water-proofing.

Figure 5H:
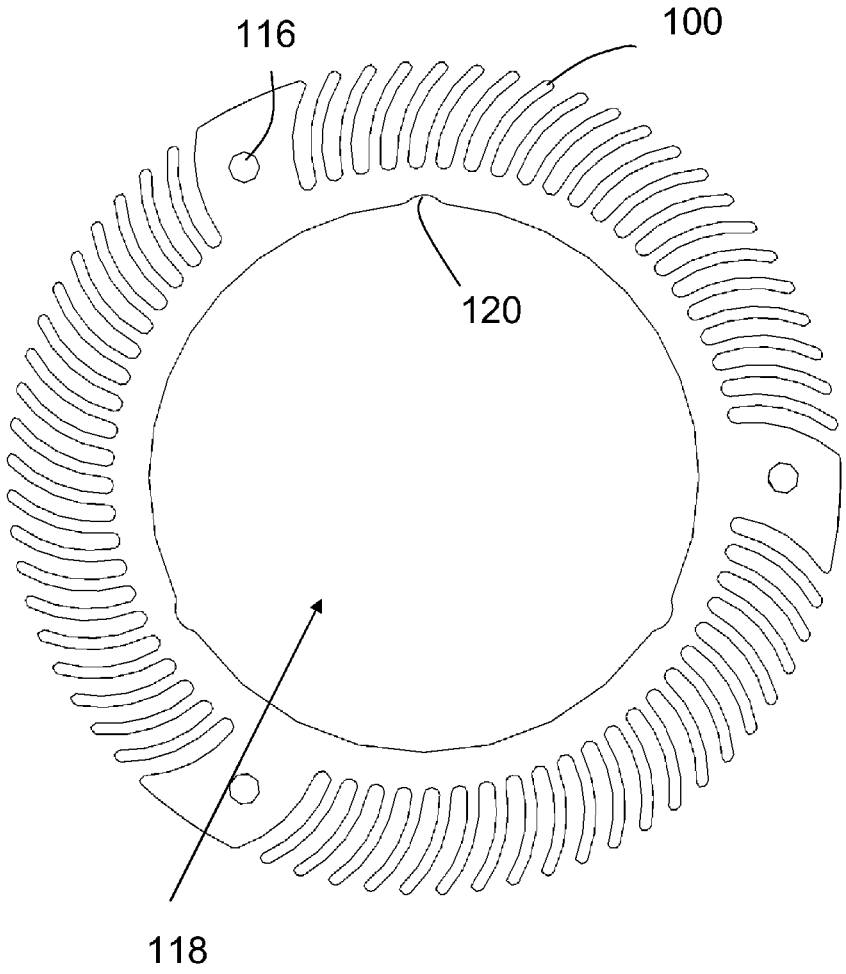
FIG. 5*h* is a top view of another embodiment of a heat sink.
Figure 6F:
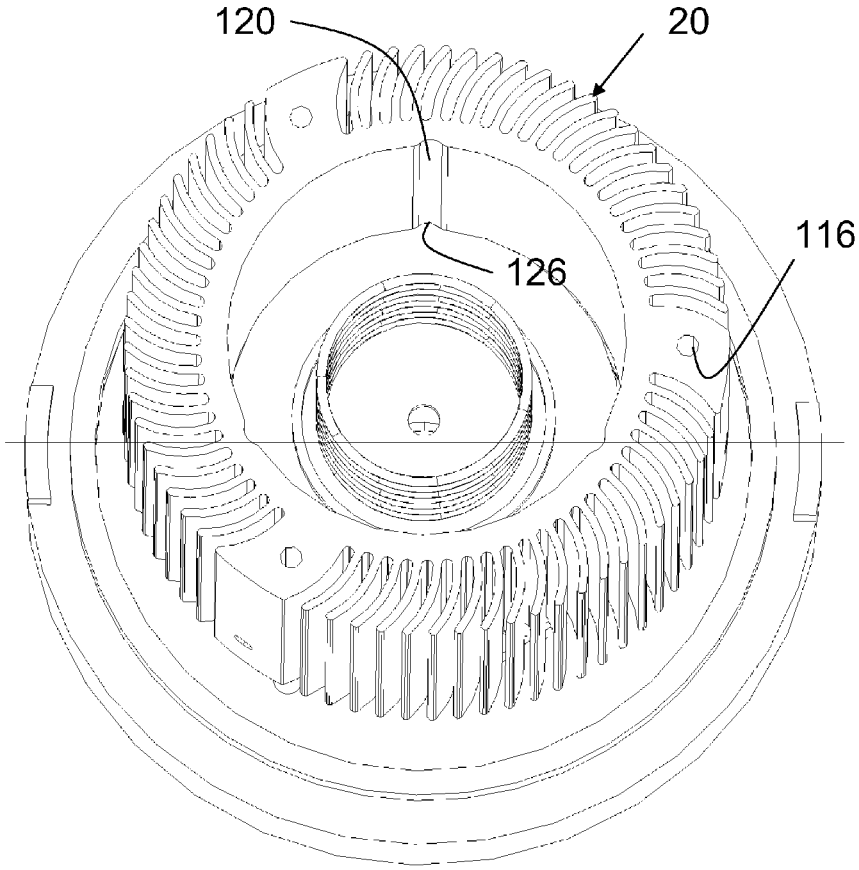
FIG. 6*f* is a perspective view of the embodiment shown in FIG. 6*d*, showing the coupling between the heat sink and the bottom member.

The vertical ridges 126 of the bottom member 124 are for interlocking to an external component such that when the external component rotates, the connector 50 can be threaded into the socket. In one embodiment, the external component is the heat sink 20 of FIG. 5*h*. The implementation of this is shown in FIG. 6*f*. The vertical ridges 126 are latched to the grooves 120 of the heat sink 20, and the heat sink 20 is attached to the top member 122 and the attaching ring 46 through the screw holes 116. When the user rotates the heat sink 20, the grooves 120 also induce rotational movement in the vertical ridges 126 which in turn causes the connector 50 to rotate.

Figure 6G:
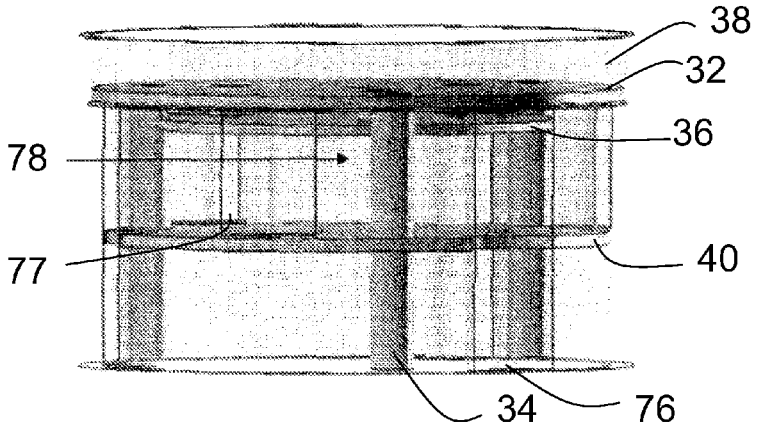
FIG. 6*g* is a diagram of an embodiment showing the space that resin is injected into, with the metal housing shown in phantom.

In one embodiment as shown in FIG. 6*g*, inside a chamber bounded by the top plate 32, the bottom plate 40 and the metal housing 38, a thermoconductive resin 78 is injected. The resin 78 fills up the chamber, including the space surrounding a power supply PCB 36.

Air is present around the power supply PCB 36, and air is a poor heat conductor, therefore heat is not efficiently transferred to the environment. The use of the resin 78 here is to improve the rate of heat transfer from the power supply PCB 36 to the metal housing 38. The density and heat conductivity of the solid resin 78 is much higher than gaseous air, so heat can be transferred to the outside more quickly. After the plates are attached to the metal housing 38, the resin 78 is injected into the chamber in a gel form at a higher temperature, such that no air gap exists between the resin 78 and the power supply PCB 36.

In one embodiment, the top plate 32 and the bottom plate 40 are made from pure aluminum for heat transfer performance. The metal housing 38 is made of an alloy comprising aluminum and magnesium for robustness while having a fair heat transfer rate.

Contrary to incandescent bulbs that use a constant voltage source as the power supply, LEDs use a constant direct current (DC) source or regulated current source for power supply. Therefore, when replacing existing obstruction lights, the power supply needs to convert the voltage source into a direct current source or a regulated current source. However, a direct current source is power consuming since it uses resistive loading, and resistors consume a lot of power.

In one embodiment, the power supply PCB 36 controls the output intensity of the LEDs 70 by a pulse width modulation (PWM) circuit. A PWM circuit outputs two current levels, namely a high level and a low level. The low level amplitude is generally set at about half the amplitude of the high level but above zero. The width of the pulse determines the average intensity output of the LEDs 70.

Using a PWM circuit as a control has several advantages over directly controlling the current amplitude. One is that the circuit can be operated by switches and does not consume current or power. Hence, the light is more efficient since less percentage of power is consumed in places other than transferring into light energy. Another advantage is that since a PWM circuit is a digital circuit, it is comparatively easy to be fabricated on an integrated circuit (IC) chip. On the other hand, analog circuit components like resistors are hard to fabricate on an IC chip, especially when high resistance is needed to reduce power consumption when biasing the circuit.

In one embodiment, the LED obstruction light 10 is controlled by a control system. The control system controls the power supply for switching on or off and the width of the pulse of the PWM circuit. In another embodiment, a variety of sensors are installed, for example temperature sensor, light sensor etc. These sensors monitor the operation of the light, and are coupled to the control system. When a light is not working properly, the control system can know immediately and respond promptly so maintenance check needs not be done as much. These components are also easy to integrate onto the power supply PCB or the LED PCB since a majority of the components are made up of digital circuit.

The exemplary embodiments of the present invention are thus fully described. Although the description referred to particular embodiments, it will be clear to one skilled in the art that the present invention may be practiced with variation of these specific details. Hence this invention should not be construed as limited to the embodiments set forth herein.

For example, an L810 light unit is used for explanation of this invention, but it is obvious to one skilled in the art to apply the inventive concepts of this disclosure to any obstruction light unit, or other light unit. For example, the light can function as an L-864 light unit by using white LEDs and controlling the LEDs to flash at a certain frequency.

The LED PCB 26 can have any number of LEDs 70 as long as they are arranged in a circularly symmetric pattern. The base of the light reflector 30 can also be a polygon such as an octagon, as long as the centers coincide with each other. In applications that omnidirectionality is not needed, these two components can have arbitrary shapes.

Any number of supporting poles 34 at any location is possible for the connector support frame 42 to slide along. Also, any method can be used to attach the metal housing 38 to the power supply and other components.

It is clear that all types of springs can be used in implementing this invention. Although compression springs are used in the above embodiments, tension springs can achieve the same effect simply by placing the spring between different elements. Coil springs and other types of springs can also be used with simple modifications clear to an ordinary person skilled in the art. Also, the springs do not need to be in lateral or vertical orientation as shown in the embodiments. As long as the connector is able to move relative to the body, orientation of the spring is not material to the invention.

The invention claimed is:

1. A light assembly comprising:

a light emitting diode light source;

a power supply connected to said light emitting diode light source, said power supply supplies electrical power to said light emitting diode light source;

a connector electrically connected to said power supply; and a connector installation mechanism adapted to adjust the height of said connector to enable said light assembly to be installed onto pre-existing fixtures whereby said light assembly is operably securable to fixtures having sockets of different heights; wherein said light emitting diode light source comprises a plurality of light emitting diodes in a circularly symmetric configuration, each said light emitting diode fitted with a lens having a shape of an inverted truncated cone, said lens reflects light emitted from said light emitting diode such that reflected light has a peak intensity between four degrees and twenty degrees above a transverse plane of said light emitting diode, said reflected light further having a same intensity in all transverse directions.

2. The light assembly according to claim 1, wherein said connector installation mechanism comprises at least one spring.

3. The light assembly according to claim 1, further comprising a body for said light assembly, wherein said body comprises a heat sink that surrounds and interlocks with said connector.

4. The light assembly according to claim 1, wherein each said light emitting diode light source comprise a plurality of light emitting diodes, each of said light emitting diode is fitted with a condensing cup.

5. A light assembly comprising:

a light emitting diode (LED) light source;

a power supply connected to said light emitting diode light source, said power supply supplying electrical power to said light emitting diode light source;

a bottom connector ring adapted to attach to different base fixtures mounted on a predetermined surface; and an adjusting mechanism comprising (i) a connector for coupling a power socket disposed inside said different base fixtures and electrically connecting to said power supply;

(i) a connector supporting frame adapted to couple to said connector;

(ii) a bottom member disposed on top of said connector supporting frame;

(iii) at least one compression spring;

(iv) at least one guiding rod, which extends from said bottom member to said connector support frame, wherein said guiding rod is in contact with both said bottom member and said connector support frame;

wherein said adjusting mechanism adapted to adjust the height of said connector in order to ensure a tight connection when said connector is threaded into said power socket, thus enabling said light assembly to be securely installed onto said different based fixtures.

6. The light assembly of claim 5, wherein said LED light source further comprises at least one LED and at least one lens attached to said at least one LED, wherein said lens is specially designed to reflect the light sideways to comply with FAA requirements of beam spread.

7. The light assembly of claim 5, wherein said connector supporting frame further comprising an adapting portion, which extends vertically downwards, for receiving said connector.

8. The light assembly of claim 7, wherein (i) said guiding rod is disposed through said compression spring; and is further connected to a top member, which is disposed on top of said bottom member;

(ii) said spring is disposed between said connector support frame and said bottom frame.

9. The light assembly of claim 7, wherein (i) said guiding rod is disposed on the side of said bottom member; and (ii) said spring is disposed between said bottom member and a top member.

10. The light assembly of claim 9, further comprising a heat sink comprising at least one groove, wherein said heat sink is attached to said top member and said guiding rod is latched to said groove.

11. The light assembly of claim 8, wherein said LED light source further comprises (i) a LED printed circuit board comprising at least one LED, where said at least one LED is mounted on a first side of said LED printed circuit board; and (ii) a reflector.

12. The light assembly of claim 11, wherein (i) said LED printed circuit board is disposed on top of said reflector and said LED printed circuit board is disposed such that said at least one LED faces said reflector; and (ii) said reflector is a concavely curved light reflector having a curved surface and is specially designed to reflect the light sideways to comply with FAA requirements of beam spread.

13. The light assembly of claim 12, further comprising at least one condensation cup shaped lens; each said condensation cup shaped lens being attached to each said LED.

14. The light assembly of claim 12, further comprising (i) an attaching ring having at least one attachment extended vertically upwards;

(ii) a metal housing surrounding said adjusting mechanism, wherein said metal housing is further attached to said attaching ring and said at least one attachment are outside said metal housing.

15. The light assembly of claim 14, further comprising (i) a plastic housing adapted to allow the light emitted from said at least one LED and reflected by said reflector to pass through;

(ii) a heat sink placed at the top of said light assembly; and (iii) a top connector ring disposed between said heat sink and said plastic housing wherein said plastic housing is disposed on top of said metal housing.

16. The light assembly of claim 15, wherein said heat sink comprising (i) a base plate attached to a heat source;

(ii) a generally cone-shaped structure having a flat side attached to said base plate; and (iii) a comb comprising a plurality of plates extending from said base plate in the direction of said generally cone-shaped structure, said plurality of plates being parallel to each other and evenly spaced apart.

* * * * *